US010858161B2

(12) United States Patent
Chandalov

(10) Patent No.: US 10,858,161 B2
(45) Date of Patent: Dec. 8, 2020

(54) BUNGEE CAP TETHER

(71) Applicant: Rina Chandalov, Brooklyn, NY (US)

(72) Inventor: Rina Chandalov, Brooklyn, NY (US)

( * ) Notice: Subject to any disclaimer, the term of this patent is extended or adjusted under 35 U.S.C. 154(b) by 83 days.

(21) Appl. No.: 15/293,662

(22) Filed: Oct. 14, 2016

(65) Prior Publication Data

US 2018/0105336 A1 Apr. 19, 2018

(51) Int. Cl.

| | |
|---|---|
| ***B65D 55/16*** | (2006.01) |
| ***B43K 23/00*** | (2006.01) |
| ***B43K 23/08*** | (2006.01) |

(52) U.S. Cl.

CPC ..... *B65D 55/16* (2013.01); *B43K 23/001* (2013.01); *B43K 23/08* (2013.01)

(58) Field of Classification Search

CPC ..... B43K 23/08; B43K 23/10; B43K 23/12; B43K 23/122; B65D 55/16; B65D 47/14; B65D 35/42

USPC ..... D9/446; 215/306; 220/375

See application file for complete search history.

(56) References Cited

U.S. PATENT DOCUMENTS

| | | | | |
|---|---|---|---|---|
| 3,033,438 A * | 5/1962 | Glass | B65D 33/12 | 383/109 |
| 3,306,483 A * | 2/1967 | Bellafiore | B65D 35/42 | 215/306 |
| 5,590,971 A * | 1/1997 | Melnick | B43K 23/122 | 401/202 |
| 7,416,424 B1 * | 8/2008 | Deckman | B65D 55/16 | 439/135 |
| 7,547,218 B2 * | 6/2009 | Hiew | H01R 13/6395 | 439/135 |
| 8,613,369 B2 * | 12/2013 | Kitto | B65D 55/16 | 215/390 |
| 9,895,579 B1 * | 2/2018 | Walterscheid | A63B 43/06 | |
| 2008/0230545 A1 * | 9/2008 | Weene | B65D 25/20 | 220/375 |

* cited by examiner

*Primary Examiner* — David P Angwin
*Assistant Examiner* — Bradley S Oliver
(74) *Attorney, Agent, or Firm* — Israel Nissenbaum; Yitzy Nissenbaum

(57) ABSTRACT

A tethering device for a utilization device (pen, marker, glue stick, etc.) having a cap. The tethering device maintains a connection between the utilization device and the cap during use of the utilization device. The tethering device comprises first and second adhering elements which conform to and adhere to an outer surface of at least one of the utilization device and the cap and an elongated flexible band having two ends positioned and connected to the first and second adhering elements respectively to flexibly connect the first and second adhering elements. The band has an effective length between the respective first and second adhering elements which is sufficient to permit the removable and replaceable cap to be removed from the utilization device and replaced thereon when the first and second adhering elements are adhered to the respective surfaces of the utilization device and the cap.

9 Claims, 5 Drawing Sheets

40
11
13

34
34a 111
23a
23
110
112
23b
11''
11
10
13
12''
12
23
23b

23

23
111
111a
110b
110
113

111b
111c 111
34
112
34

23'
23a
23
13
23b 23
110
111
112

BUNGEE CAP TETHER

FIELD OF THE INVENTION

This invention relates to tethers used for keeping caps of capped devices such as pen and marker and even glue stick caps from being separated from the main body of the pen, marker or glue stick and lost, and particularly relates to after-market tethers used on removably capped devices not originally configured for cap tethering.

BACKGROUND

Many pens and markers, which are not of the push-button retractable type, are provided with caps, which cover the writing or marking nibs when not in use. These caps serve the purpose of preventing the pens and markers from inadvertently marking clothing such as pockets in which they are typically carried and also prevent the inks contained therein (and on the nibs) from drying out. Glue sticks are of a similar nature but with the concern primarily being of drying out Despite the fact that the caps are often configured to be placed on the closed end of the pen or marker (hereinafter, for simplicity, items with removable caps such as pens, markers, glue sticks, stylii (styluses), flash drives and the like will be referred to herein as "removably capped device(s)", "capped device(s)" or "uncapped device(s)", unless separately specified) for retention during use, their loss is often inevitable, particularly when the pens or markers are used by children or absent minded adults. In order to prevent separation and loss of caps for capped devices there have been multitudes of expedients in the prior art, mainly entailing the use of string, rubber band or chain tethers to keep the cap attached to the device.

Such tethers fall into two categories, with a first being tethers which are integrated with the capped device body and directly to the cap during manufacture. A second category includes tethers which may be attached to the devices and caps therefor by the user but wherein the devices are specifically configured to accept the tether and the tether is to be provided with the devices by the manufacturer. Very few, if any tethers of the latter category, exist in the common marketplace. Thus, if a user purchases a device without a manufacturer-provided tether, there is often no effective way to properly keep a device and a cap therefor from being separated, with possible loss of the cap (devices themselves are rarely lost since they are being used).

SUMMARY OF THE INVENTION

It is accordingly an object herein to provide an after-market user-installed or affixed tether for a capped device particularly an elongated device such as a pen/marker/glue stick/flash drive, etc. to maintain the device and cap from being separated and with the cap being inadvertently lost.

It is a further object herein whereby the tethering device is able to embody decorative elements which may be user-selected to personalize use thereof and to make their use appealing, particularly to children.

It is yet another object herein to provide a tethering device which is universally utilizable even on items such as pens, markers, glue sticks, flash drives and the like, not originally configured for tethering of the cap to the device.

It is still yet another object herein to provide a tethering device configured to provide attachment of a cap to a device which does not have a seat for holding an uncapped cap.

Generally an embodiment herein comprises a tethering device having adhering elements for respective attachment, by a user, of the tethering device to both a surface of a removably capped device such as a pen, marker, glue stick, flash drive and the like and to a surface of the removed cap. The attached adhering element is connected with an extending tethering element whereby the device remains attached to the removed cap whether the cap is seated on a closed or non-operational end of the device or removably attached to the device itself. The effective length of the extending tethering element between the adhering elements is a length sufficient to permit removal of the cap from an operational end of the device (nib of a pen, marking felt of a maker, glue of a glue stick, etc.) and to permit seating or attachment of the cap to the device at a temporary uncapped holding position. If the tethering element is elastic then the minimal length is an effective length which is measured as a non-deteriorating stretched length. Since it is a surface of the device or cap to which the adhering elements are adhered, such surfaces are universal for nearly all devices and caps therefor without need for connecting elements such grooves or apertures as used with prior art tethers requiring specifically configured devices and/or caps.

The tethering device disclosed herein is for a utilization device having a removable and replaceable cap which covers an operational element of the utilization device and is removed therefrom for use of the utilization device and is replaced thereon during non-use. The tethering device is configured for maintaining a connection between the utilization device and the removable and replaceable cap during use of the utilization device, and comprises:

a. a first adhering element configured to conform to and adhere to an outer surface of at least one of the utilization device and the removable and replaceable cap,
b. a second adhering element configured to conform to and adhere to an outer surface of the other of the utilization device and the removable and replaceable cap, and
c. an elongated flexible band having two ends positioned and connected to the first and second adhering elements respectively to flexibly connect the first and second adhering elements.

The elongated flexible band has an effective length between the respective first and second adhering elements which is sufficient to permit the removable and replaceable cap to be removed from the utilization device and replaced thereon when the first and second adhering elements are adhered to the respective surfaces of the utilization device and the removable and replaceable cap.

In one embodiment, the tethering device comprises a band, i.e., "bungee" cord, of a length sufficient to extend from an approximate mid-point of a capped device extending away therefrom to about the midpoint of a cap for the device with little or no residual slack when the device is capped (it is understood that this dimension may vary depending on the specific device being used and the positioning need not be exact nor should the placement interfere with capping or uncapping). The mid-point positioning is most often utilizable where the device is configured for seating of the cap on an end opposite that of the operational end of the device.

A flat band embodiment provides further advantages of reduced tearing possibility and easier handling and placement and elasticity of the band, in another embodiment, provides further easier placement and handling. The two ends of the band are each respectively firmly adhered to a small adhesive panel such as with a sandwich adhesion between two layers of the panel in a bi-layer or tri-layer embodiment (with the end of the band or cord being adhesively contained within a sandwiched third layer) and an outer surface of the panel being provided with an adhesive for attachment to a surface of the device and/or surface of the cap thereof. At least one layer of the panel comprises an adhesive surface such as of a peel-off adhesive type by which the panel is securely adhered to either of the device surface or the cap surface. In a further embodiment herein the second exposed surface of each of the panels is available for placement of a personalized and/or decorative elements, name and address identification and the like. In addition, the panels themselves may be of various decorative configurations such as hearts, stars, etc. Despite the lack of slack in an ideal positioning, the elastic band or bungee between the adhered cap/panel and pen/panel, provides sufficient give to enable the cap to be placed over the operative end of the uncapped device or any configured cap holding end of the device.

During use of the uncapped device, the device may provide a temporary seat for the cap for holding it in a loose tethered position relative to the device.

With some pens and, more commonly, markers and glue sticks, flash drives and the like, which do not have cap holding ends, an embodiment of the tether described herein includes magnetic elements in each of the panels whereby the temporary holding of the cap during use of the device is effected by proximate touching of the respective panels on the cap and the uncapped device and a resulting temporary magnetic attachment therebetween.

Though round and thin tethering bands are within the purview of the invention, a flat configuration of the band, as used in an embodiment of the tether herein, obviates its inadvertent function as a cutting element whereby the attachment thereof to the cap and device body has a reduced susceptibility to cutting, tearing and general deterioration of the connection of the cord to the cap or pen.

The above and other objects, features and advantages will become more evident from the following discussion and drawings in which:

SHORT DESCRIPTION OF THE DRAWINGS

FIGS. 1*a* and 1*b* depict top and bottom views of the bungee cord tether as disclosed herein with typical dimensions;

FIG. 2 depicts a blown up fabrication procedure of a tether panel and cord attachment and panel fabrications;

FIGS. 3*a-d* depict various ornamental and inscribable embodiments of the bungee cord tether;

FIGS. 4*a-c* depict a pen, a marker and another type of pen with fastened bungee cord tethers of various ornamental appearance on the caps and bodies thereof respectively;

Figures 8A, 8B, 9, 11, 12, 13A, 13B, 14, 15A, 15B:
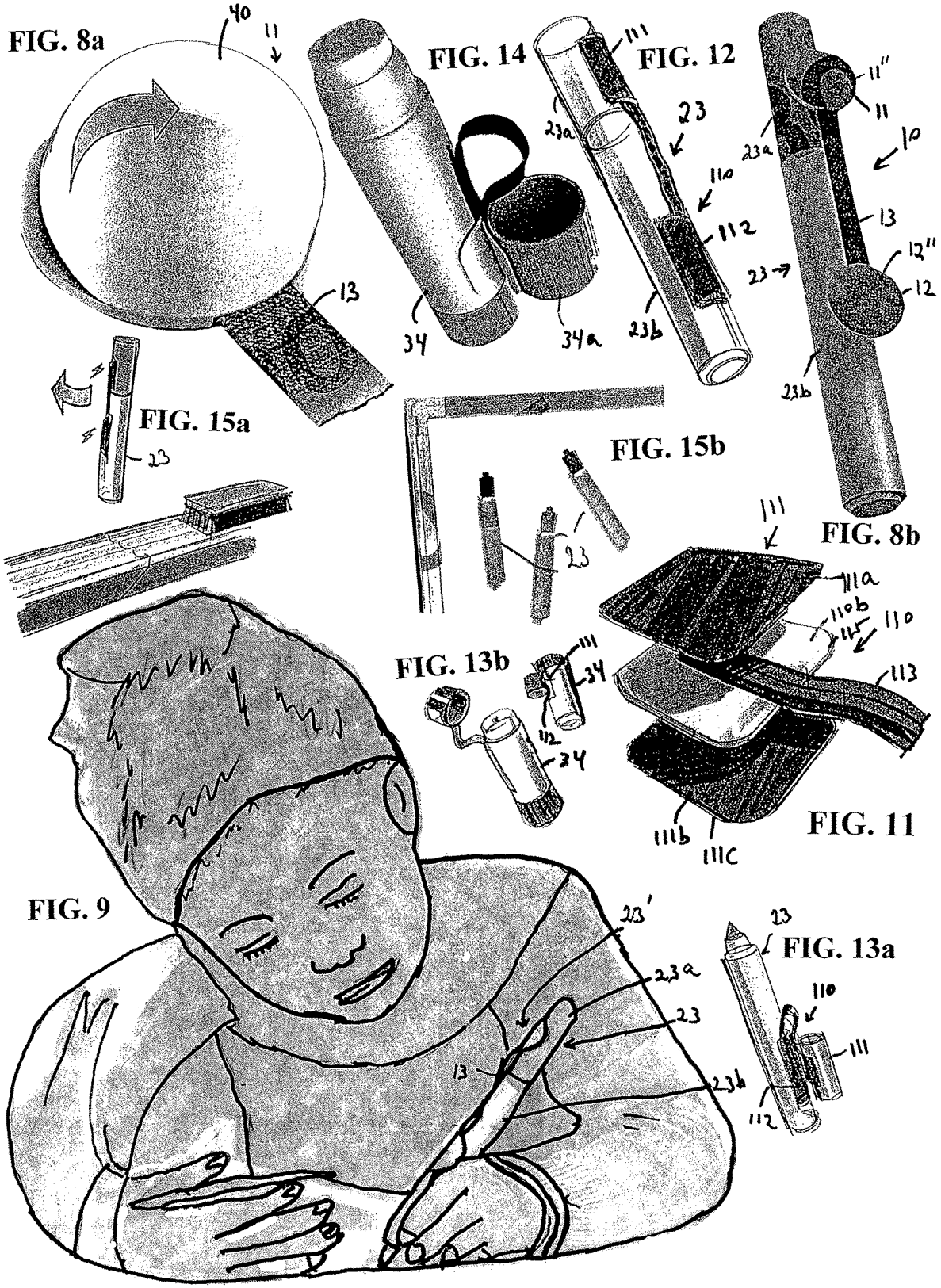

FIGS. 8*a* and 8*b* depict the peeling of the panel to expose the adhesive attachment surface and the placement on both marker and cap respectively.

FIG. 9 shows a child using a marker with a tethered cap;

FIGS. 10*a-d* are a mock-up depiction of a cardboard carrier for the bungee cord tether, the placement of the tether with cardboard carrier on a pen and cap, and removal of the carrier with separation of the cap and pen, respectively;

FIG. 11 is an exploded view of a panel showing another embodiment with a magnetic structure;

FIG. 12 is a marker with magnetically attachable tether panels;

FIGS. 13*a* and 13*b* depict a marker and glue stick respectively, which do not have cap-holding ends with FIG. 13*b* depicting a magnetic holding;

FIG. 14 is an expanded view of the magnetic holding between cap and glue stick of FIG. 13*b;*

Figure 16:
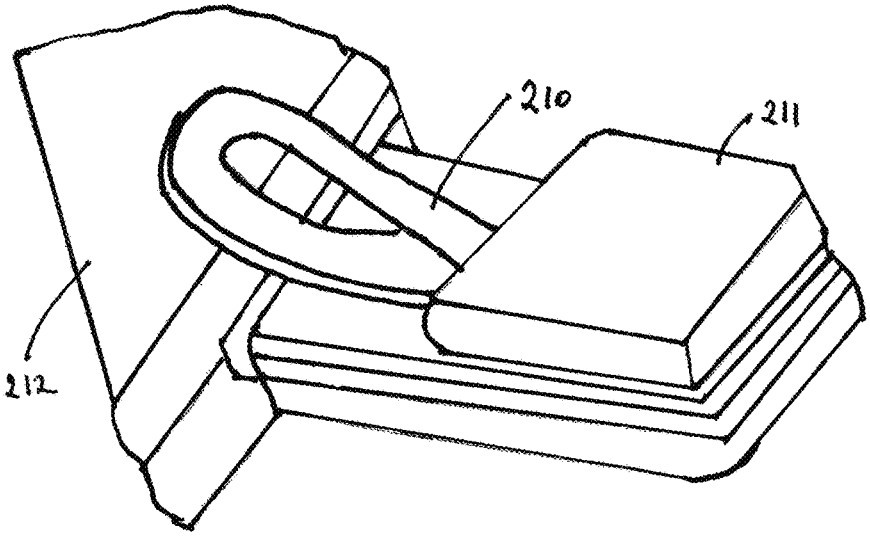

FIGS. 15*a* and 15*b* depict the placement and holding of different markers on whiteboards having magnetically attractive metallic bases;

FIG. 16 is an example of the bungee cord tether as placed on a flash drive and cap during use of the flash drive; and FIGS. 17*a-e* depict a packaging carrier and application of an enclosing wrapper with sequential operation placement similar to that of a bandage application.

DETAILED DESCRIPTION

Figures 1A, 1B:
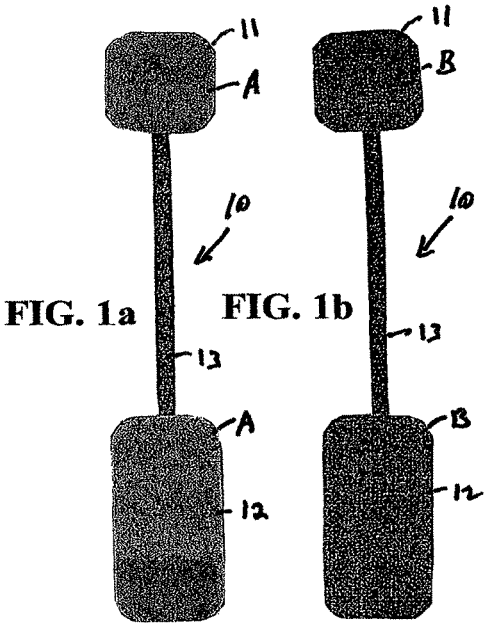

As shown in the figures all of the bungee cord tethers 10 shown therein have the basic elements of adhesive panels 11 and 12 with a connecting elastic flat band 13 therebetween, with ends thereof imbedded in or attached to the respective panels and firmly adhered thereto. As shown in FIGS. 1*a* and 1*b,* the panels 11 and 12 have respective opposite surfaces (exposed top surface A in FIG. 1*a* and adhesive bottom surface B shown in FIG. 1*b* of panels 11 and 12 which are attached to the cap and pen respectively. Panels 11 and 12) are interchangeable with respect to their relative attachment to the cap or to the pen body. Dimensions shown of 0.75" square panel 11 and 1.5"×0.75", of rectangular panel 12, are shown only as exemplary of a utilizable dimension which may be decoratively or usefully varied. Similarly, the two inches between panels 11 and 12 shown in FIG. 1*a* and the overall length of the bungee tether 10 in FIG. 1*b* is typically exemplary with dimensions being variable with respect to particular use and dimension of the pen, marker, glue stick, flash drive, stylus and the like, to which the tether is configured.

Figure 2:
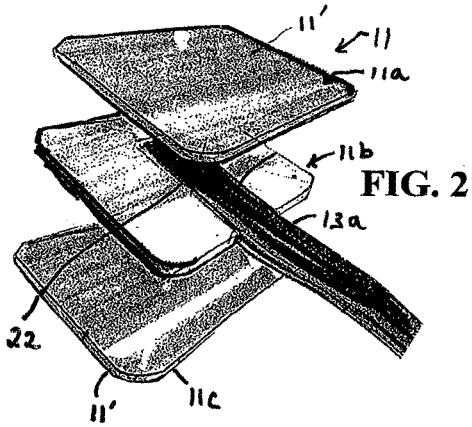
Figure 7:
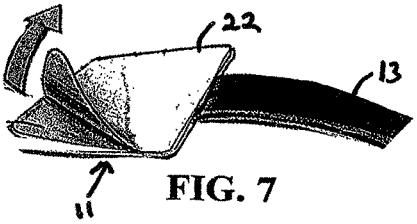
FIG. 7 shows the center layer of the panel having an additional adhesive layer for increased integrity of the panel attachment to the pen or cap.

The composition of a panel 11 (with panel 12 being similarly constructed) is shown in FIG. 2 as being comprised of adhered layers 11*a,* 11*b* and 11*c* with vinyl or other plastic or other durable material outer layers 11*a,* with printable or writable exposed upper surface 11' and with the lower surface 11" being coated with an adhesive for attachment to the pen or cap. The adhesive in a common embodiment is a peel-off one with a removable protective paper layer 22, as shown in FIG. 7.

As shown in FIG. 2, an end 13*a* of the elastic band 13 is imbedded in a slot 21 in foam layer 11*b* of panel 11 (a similar placement is done with respect to the other end of the elastic band 13 and panel 12). Elastic band 13 in one embodiment is comprised of a structurally reinforced fabric-elastic material, such as spandex, for example sold as Lycra (Dupont trademark), similar to those used in clothing, with a relatively limited stretching compared to typical rubber bands. The degree of stretching of the elastic band 13 should be sufficient to enable the cap, on which it is placed to be removable from the pen and replaceable thereon and to allow for variations in placement positioning of the panels at the ends of the elastic band on the cap and pen.

With placement of the end 13*a* of the elastic band 13 within slot 21, the end 13*a* is, in various embodiments, strongly adhered to the foam layer 11*b* by adhesive coating thereof to adhere the end 13*a* and elastic band end 13*a* as well as adhering layers 11*a* and 11*b* thereto in a sandwich structure. Other adhesion expedients include heat and ultrasound adhesions and the like, as appropriate for the specific materials being used. In addition to the reinforcement provided by the fabric interwoven in the elastic, end fibers of the fabric increase adhesion strength of the bond between elastic band 13 and the respective panels 11 and 12. The width and flat surface of the elastic band at its end 13*a* also facilitates strong adhesion connection with a greater area for adhesion and a closer juxtaposition between the adhered parts.

Figure 3A:
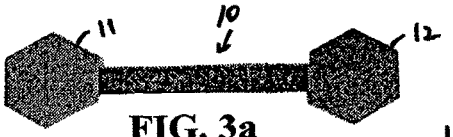
Figure 3B:
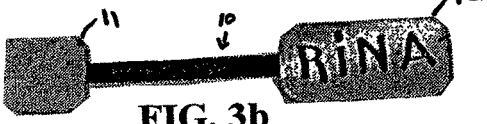
Figure 3C:
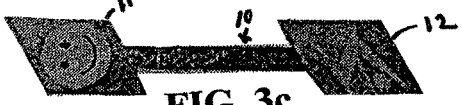
Figure 3D:
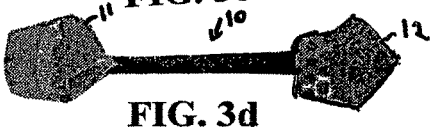

FIGS. 3*a-d* illustrate various decorative embodiments for the bungee cord tethers 10 with different configurations of the panels 11 and 12. In FIG. 3*a*, the panels each have a hexagonal shape. The panels 11 and 12 of FIG. 3*b* are those of FIGS. 1*a* and 1*b* with square panel 11 and rectangular panel 12, with the latter having a writable surface for writing indicia, such as the shown owner name. FIG. 3*c* shows panels 11 and 12 of parallelogram configuration and FIG. 3*d* depicts panels 11 and 12 being of decorative cupcake representations.

Figure 4A:
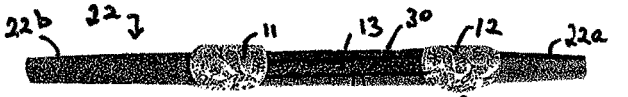
Figure 4B:
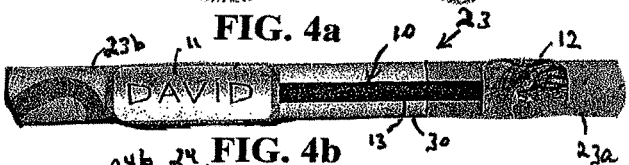
Figure 4C:
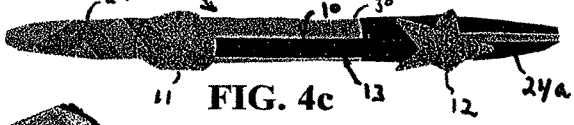
Figure 5:
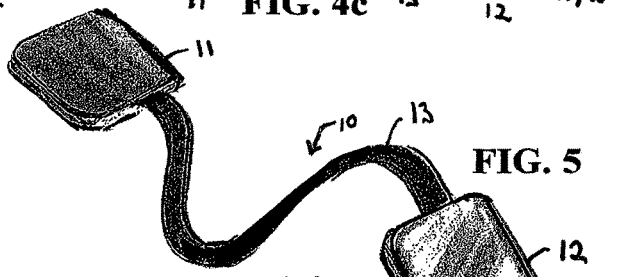
FIG. 5 shows a bungee cord tether with flexibility.
Figure 6:
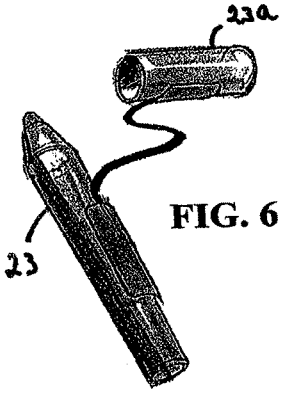
FIG. 6 depicts a marker with a tethered bungee cord and the cap removed.

FIGS. 4*a* through 4*c* show the placement of the tethers 10 with different sizes and shapes of panels 11 and 12 on pens 22 and 24 in FIGS. 4*a* and 4*c* and marker 23 in FIG. 4*b*. Optimally, as shown in all three FIGS. 4*a-c*, the respective panels 11 and 12 are positioned and adhesively attached at about the midpoints of the longitudinal length of the cap and pen bodies respectively (the pen midpoint as described herein does not include the length the pen body contained within the cap in the covered position). The elastic band 13 extends across the dividing line 30 between cap and pen and is sufficiently elastic to permit the respective caps 22*a*, 23*a* and 24*a* to be lifted and removed from the respective pens 22*b* and 24*b* and marker 23*b*. FIG. 5 illustrates the flexibility of the elastic band 13 with the tethered removal of cap 23*a* from marker 23*b* shown in FIG. 6.

FIGS. 8*a* and 8*b* depict a simple procedure with which a tether is attached to a marker 23 and its cap 23*a* and marker body 23*b*. In FIG. 8*a* paper 40 is peeled off and removed from panel 11 (similar paper is removed from panel 12, not shown) to expose an underlying adhesive on the panel. In FIG. 8*b*, the panels 11 and 12 are obverted with adhesive surfaces 11" and 12" being placed adjacent the approximate mid points of cap 23*a* and marker body 23*b* with elastic cord 13 is kept taut but not stretched. Panels 11 and 12 are brought into adhesive contact with the respective cap and marker 23*a* and 23*b* to complete the tethering. The tethered cap and marker, with the elastic 13 being folded over and away from the marker tip, is shown in FIG. 9, with a child using the marker 23, with cap 23*a* being positioned on the marker end 23' and tethered to the marker body 23*b*.

Figure 10A:
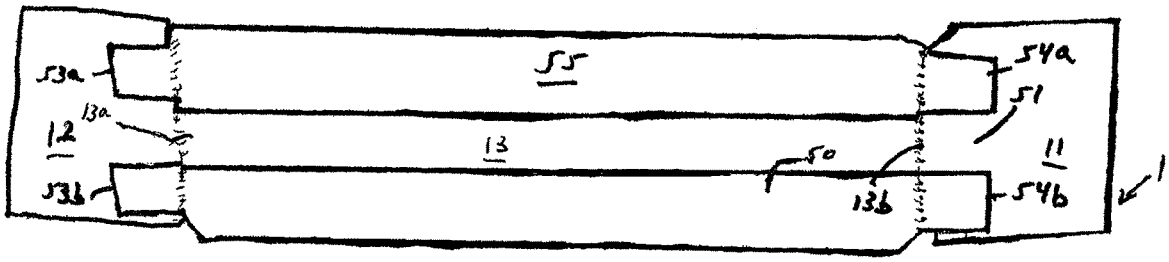
Figure 10B:
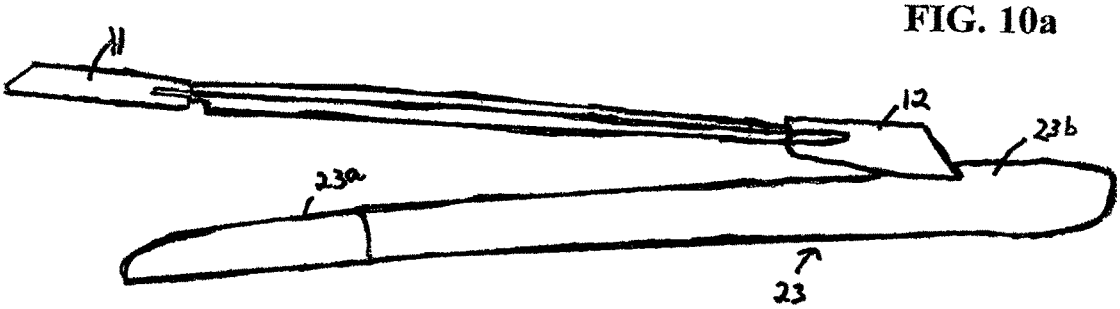
Figure 10C:
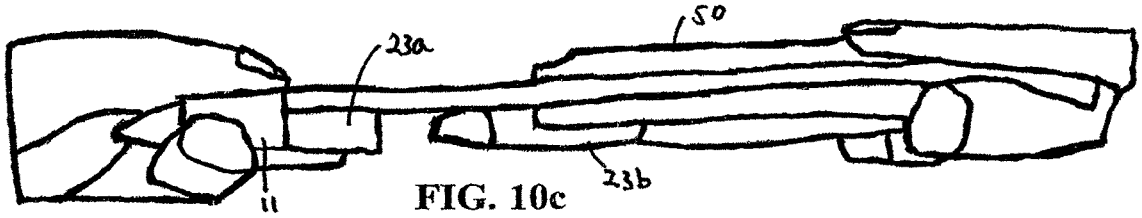
Figure 10D:
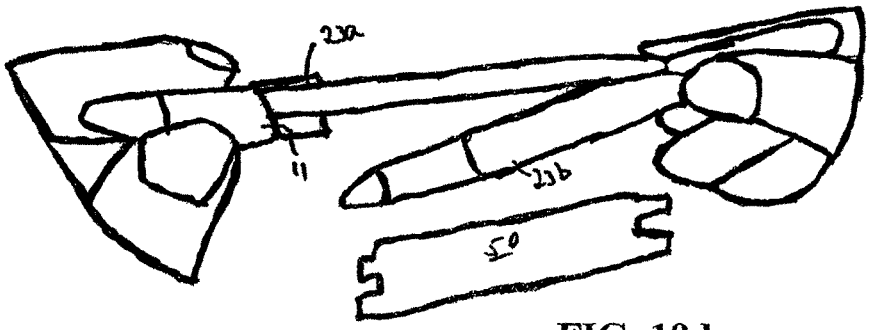

FIGS. 10*a-d* depict a tether emplacement embodiment with an applicator 50 such as of cardboard (which may also be used as part of packaging for the tether), which holds the tether 10 in extended position. The applicator 50 is a short rectangular strip of cardboard having end slots 51 and 52 forming panel retention fingers 53*a* and 53*b* and 54*a* and 54*b* respectively and a flat section 55.of a length approximately equivalent to the length of elastic band 13. The opposite ends 13*a* and 13*b* of band 13 are fitted into slots between fingers 53*a* & 53*b* and 54*a* & 54*b*. The band 13 is supported by flat section 55 and the panels 11 and 12 extend outside the applicator 50 and are unsupported therewith. As shown in FIG. 10*b*, the applicator 50 with retained tether 10 is placed on a marker 23, the peel-off adhesive is removed from the panels 11 and 12 (not shown) and the panels 11 and 12 are adhered to cap 23*a* and marker body 23*b* respectively. As shown in FIGS. 10*a* and 10*b*, removal of the cap 23*a* from the pen body 23*b* automatically causes the applicator 50 to fall off for disposal.

FIGS. 11-15*b* relate to another embodiment of the tether disclosed herein, where the capped pen, marker, glue stick and the like are not configured to provide a supporting rest for the cap when the pen, marker, glue stick and the like is being used. This is most common with many markers and glue sticks, which are simple cylinders without shaped cutouts for holding a cap.

As shown in FIG. 11, the panel 111 is made as in the prior embodiment with the sandwich sheets 111*a* and 111*c* and sandwiched foam sheet 111*b* adhered to elastic band 113. However, and additional layer of a magnetic sheet 115 is centrally attached to foam sheet 110*b* and is sandwiched therewith in the panel 111 structure. As shown in FIG. 12, marker 23 is shown with cap 23*a* and marker body 23*b*, which is cylindrical and without a seat for cap 23*a* at it closed end. The tether 110 is adhered to the cap 23*a* and marker body 23*b* as with the prior embodiment. However, end panels 111 and 112 are magnetic with enclosed contained magnetic sheets 115. Accordingly, cap tethering attachment (in the absence of a cap seat on the marker or glue stick body) is directly between the magnetic panels 111 and 112 as shown in FIGS. 13*a*, 13*b* and 14 for marker 23 and glue stick 34 respectively. In addition, to the tethering, the inclusion of a magnetic element in the tether, enables the markers 23, shown in FIGS. 15*a* and 15*b* to be attached to and retained for handy use by typical whiteboards or refrigerators having magnetically susceptible metal bases. FIG. 16 depicts a tether 210 attached to a flash drive 211 while it is being used with computer 212.

FIG. 17 depicts another tether applicator/carrier 60 in the form of a paper enclosure. In FIG. 17*b* a top layer 60*a* of the applicator/carrier 60 is peeled off from bottom layer 60*b*, similar to a bandage package, to reveal the tether 10 with the adhesive sides 11" and 12" of panels 11 and 12 being exposed. As shown in FIG. 17*c*, the bottom layer 60*b* is grasped and the adhesive portions 12" and 11" placed on the marker body 23*b* and cap 23*a* respectively and peeled off (FIG. 17*d*) to provide the emplaced tether 10 on marker 23 (FIG. 17*e*).

Figure 17A:
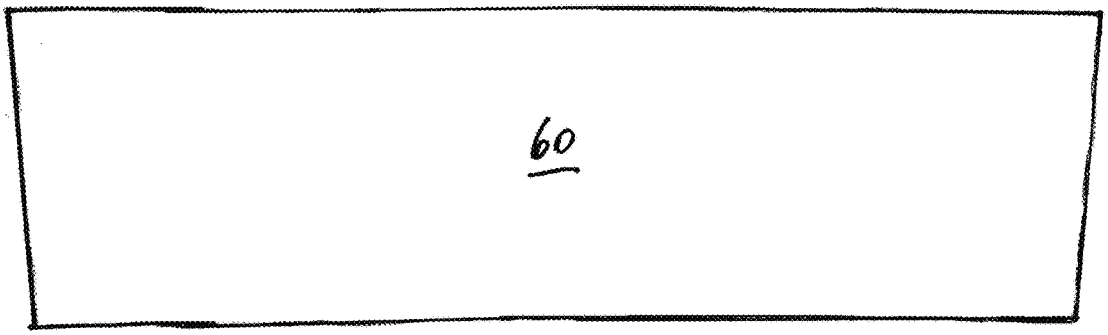
Figure 17B:
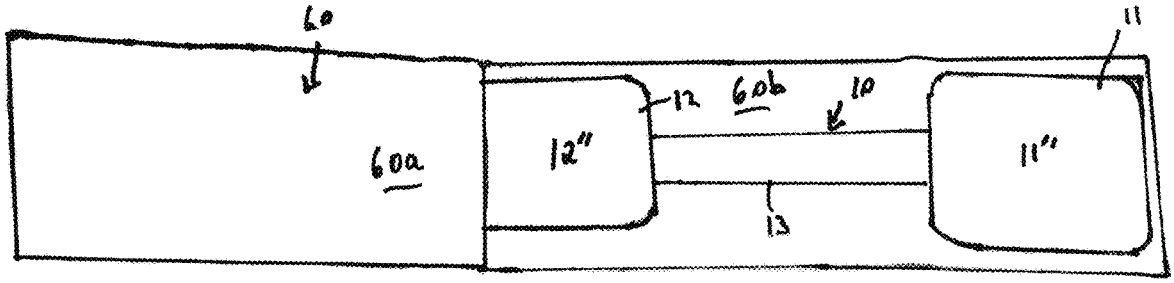
Figure 17C:
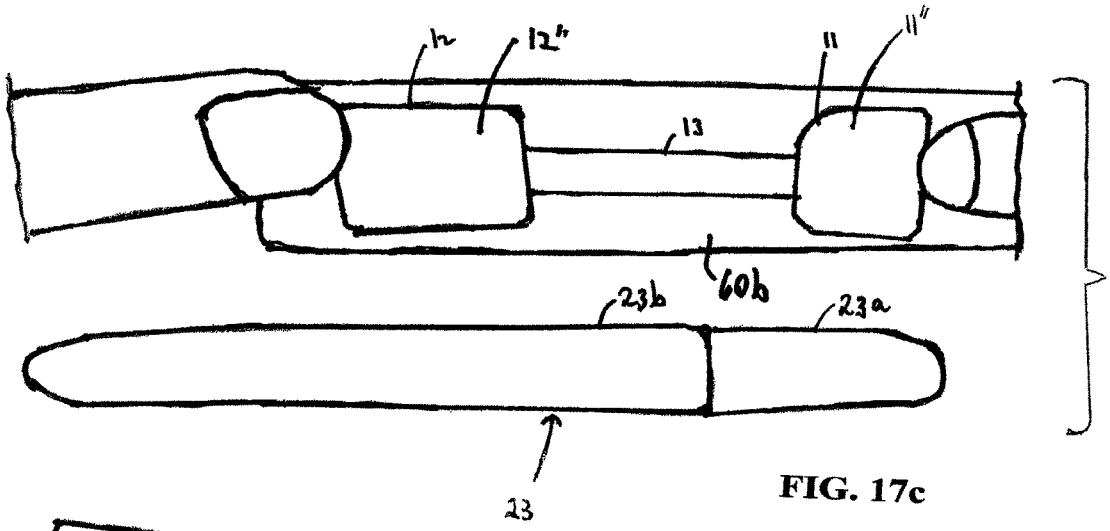
Figure 17D:
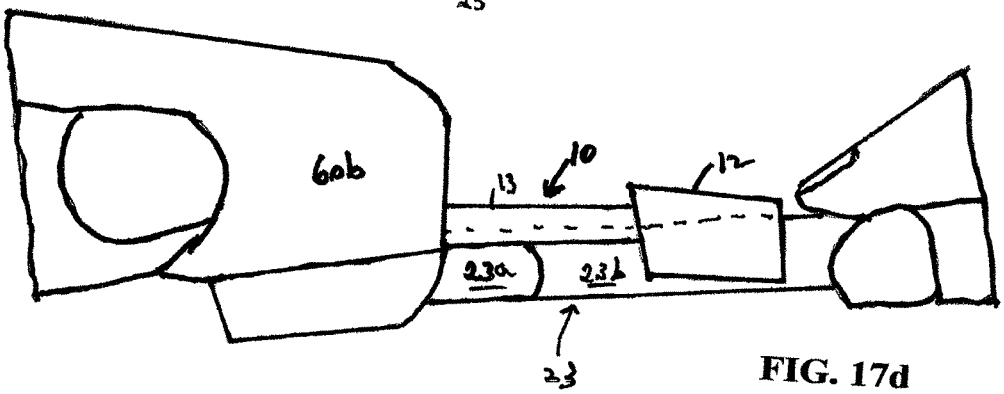
Figure 17E:
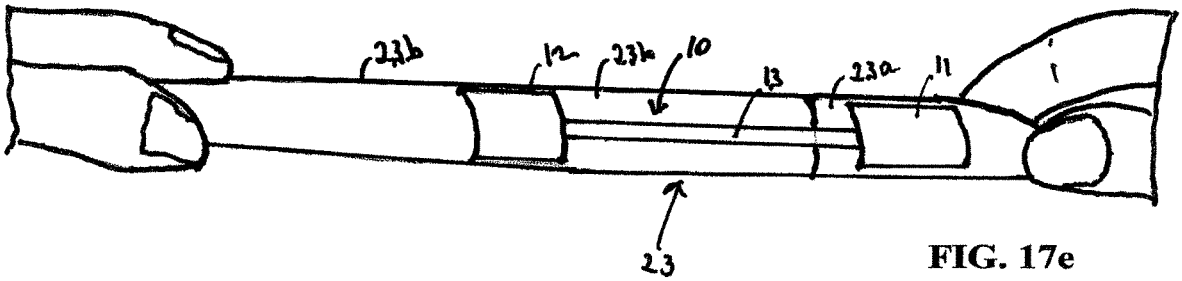

In a variation thereof shown, the tether is sandwiched in a folded-over transparent plastic and the adhesive surfaces are exposed with unfolding of the plastic sandwich and as with the embodiment of FIG. 17*c*, the unfolded carrier is grasped to place the adhesive panels on a marker to provide the emplacement with peeling off of the remaining plastic.

It is understood that the above description and illustrated embodiments are only exemplary of the invention and the type of capped devices and that other capped devices as well as changes in components and structure may be made without departing from the scope of the invention as defined in the following claims.

What is claimed is:

1. A tethering device in combination with a longitudinally elongated manually manipulated utilization device selected from the group consisting of a pen, a marker, a glue stick, and a stylus with each having a removable and replaceable cap which covers an operational segment of the utilization device and is removed therefrom for continued manual use of the utilization device and is replaced thereon during non-use, the tethering device being configured for maintaining a connection between the utilization device and the removable and replaceable cap during the continued manual use of the utilization device, and comprising:

a. a first adhering panel conformed to and adhered to an outer surface of at least one of the utilization device and the removable and replaceable cap, b. a second adhering panel conformed to and adhered to an outer surface of the other of the utilization device and the removable and replaceable cap, and c. an elongated flexible stretchable elastomeric band having two ends positioned and connected to the first and second adhering-panels respectively to elastically connect the first and second adhering panels and wherein the band, when attached to both the utilization device and cap in a capped position, extends in a linear direction without slack and in close proximity to the utilization device and the cap, wherein the stretchable elastomeric elongated flexible linearly extending band has an effective stretchable length between the respective first and second adhering panels sufficient to permit the removable and replaceable cap to be removed from the utilization device and replaced thereon with the first and second adhering panels being adhered to the respective surfaces of the utilization device and the removable and replaceable cap, and wherein the utilization device comprises a seat thereon for the temporary holding of the removable and replaceable cap during continued manual use of the utilization device and wherein a stretchable effective length of the elastomeric elongated band is of sufficient length to permit the removable and replaceable cap to be seated on the seat for the temporary holding thereof.

2. The tethering device of claim 1, wherein the first and second adhering panels comprise respective substantially flat panels each having a respcctive coextensive surface covered with an adhesive of sufficient adhesion strength to provide the respective adhering of the first and second adhering panels to the surfaces of the utilization device and removable and replaceable cap.

3. The tethering device of claim 2, wherein the flat panels have decorative design or shape configurations.

4. The tethering device of claim 2, wherein the strength of the adhesive is sufficient to substantially prevent unwanted removal of the respective adhering panels from the respective surfaces of the utilization device and the removable and replacable cap, resulting from elongated stretching of the elastomeric elastic band and during the continued manual use of the utilization device.

5. The tethering device of claim 2, wherein the flat panels are each comprised of at least two bonded layers and wherein two ends of the elongated flexible band are adhesively imbedded between layers of the respective flat panels.

6. The tethering device of claim 2, wherein the flat panels include a magnet within at least one of the respective flat panels and a magnetically susceptible material on the other of the flat panels whereby the juxtaposition of the respective panels provides a temporary magnetic holding therebetween to provide the temporary holding seat for the removable and replaceable cap when the utilization device is in use.

7. The tethering device of claim 2 wherein one or both flat panels have an exposed writable surface.

8. The tethering device of claim 1, wherein the band is flat.

9. The tethering device of claim 8, wherein the tethering device further comprises an elongated application carrier configured to support and carry the elastomeric band in an extended configuration and with the application carrier having extension members at opposite ends thereof and out of line of the elastomeric band whereby the extension members respectively support the first and second adhering panels on non-adhering sides of the first and second adhering panels to leave a respective coextensive surface free fordirect adhering of the first and second adhering panels to the surfaces of the utilization device and removable and replaceable cap and removal of the application carrier from the tethering device thereafter with separation of the utilization device and cap.

* * * * *